US011259109B2

(12) United States Patent
Cao et al.

(10) Patent No.: US 11,259,109 B2
(45) Date of Patent: Feb. 22, 2022

(54) IN-EAR EARPHONE

(71) Applicant: LUXSHARE PRECISION INDUSTRY CO., LTD., Shenzhen (CN)

(72) Inventors: Jiaoping Cao, Hong Kong (CN); Zhenhua Liu, Hong Kong (CN); Yun Feng, Hong Kong (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 0 days.

(21) Appl. No.: 16/934,694

(22) Filed: Jul. 21, 2020

(65) Prior Publication Data

US 2021/0266653 A1 Aug. 26, 2021

(30) Foreign Application Priority Data

Feb. 25, 2020 (CN) ..... 202020205406.4

(51) Int. Cl.

*H04R 1/10* (2006.01)
*H04R 1/02* (2006.01)
*H04R 9/06* (2006.01)

(52) U.S. Cl.

CPC ..... *H04R 1/1016* (2013.01); *H04R 1/02* (2013.01); *H04R 1/1066* (2013.01); *H04R 9/06* (2013.01)

(58) Field of Classification Search

CPC ... H04R 1/1075; H04R 25/604; H04R 25/652
See application file for complete search history.

(56) References Cited

U.S. PATENT DOCUMENTS 8,103,031 B2 * 1/2012 Ho ..... H04R 25/604 381/322
8,116,501 B2 * 2/2012 Kusuda ..... H04M 1/05 381/380
8,385,574 B2 * 2/2013 Aquilina ..... H04R 25/656 381/328
8,649,540 B2 * 2/2014 Killion ..... H04R 1/1041 381/321
8,800,712 B2 * 8/2014 Campbell ..... H04R 25/656 181/135

(Continued)

FOREIGN PATENT DOCUMENTS

JP 2011009909 A * 1/2011

*Primary Examiner* — Ryan Robinson
(74) *Attorney, Agent, or Firm* — Birch, Stewart, Kolasch & Birch, LLP

(57) ABSTRACT

An in-ear earphone includes an earphone housing, a speaker assembly fixed onto the earphone housing, and an electric energy portion electrically connected to the speaker assembly, a sound emitting tube and an ear tip, where one end of the sound emitting tube is fixed onto the earphone housing, where the sound emitting tube has a first through hole; and the ear tip is fixedly connected to the other end of the sound emitting tube, a cross-section of the ear tip is oval-shaped, the ear tip has a first end and a second end that face to each other, the ear tip has a stepped hole penetrating through the first end and the second end, a part of the sound emitting tube is located in a large-diameter section of the stepped hole, and a small-diameter section of the stepped hole is in communication with the first through hole.

12 Claims, 16 Drawing Sheets

(56) References Cited

U.S. PATENT DOCUMENTS

| | | | | |
|---|---|---|---|---|
| 8,885,866 | B2 * | 11/2014 | Sakaguchi | H04R 25/652 381/382 |
| 8,942,406 | B2 * | 1/2015 | Koizumi | H04R 1/1091 381/380 |
| 9,197,959 | B2 * | 11/2015 | Fukushima | H04R 1/1058 |
| 10,149,034 | B2 * | 12/2018 | Tsubone | H04R 1/2857 |
| 10,869,115 | B2 * | 12/2020 | Cohen | H04R 1/1016 |
| 2010/0084217 | A1 * | 4/2010 | Blanchard | A61F 11/08 181/135 |
| 2011/0223864 | A1 * | 9/2011 | Wai | H04R 25/656 455/41.3 |
| 2012/0076341 | A1 * | 3/2012 | Ozawa | H04R 1/345 381/380 |

* cited by examiner

IN-EAR EARPHONE

CROSS-REFERENCE TO RELATED APPLICATION

This application claims priority to a Chinese patent application No. 202020205406.4 filed on Feb. 25, 2020, disclosure of which is incorporated herein by reference in its entirety.

TECHNICAL FIELD

The present disclosure relates to the field of audio technology, in particular, to an in-ear earphone.

BACKGROUND

In-ear earphones are widely used in audio output of electronic products because of good sound quality and portability thereof.

In the related art, the in-ear earphone generally includes an ear tip, a protection housing connected to the ear tip, and a speaker unit located in the protection housing. In addition, an outer contour of the ear tip in the related art is round, which makes it difficult for the ear tip to get stuck in an auricle when the in-ear earphone is being worn. That is, the ear tip in the related art is not easy to be inserted into the human ear, and is of poor comfort performance after being inserted into the human ear.

SUMMARY

A purpose of the present disclosure is to provide an in-ear earphone, which is capable of being easily stuck in an auricle and improving comfort performance of the in-ear earphone after being inserted into the human ear.

The present disclosure provides technical solutions described below.

An in-ear earphone includes an earphone housing, a speaker assembly fixed onto the earphone housing, and an electric energy portion electrically connected to the speaker assembly, and further includes: a sound emitting tube, one end of which is fixed onto the earphone housing, where the sound emitting tube is bent-shaped, and has a first through hole penetrating through both ends of the sound emitting tube; and an ear tip fixedly connected to the end of the sound emitting tube, where a cross-sectional shape of the ear tip is oval-shaped, the ear tip has a first end and a second end that face to each other, a plane where an end surface of the first end is located is configured to intersect with a plane where an end surface of the second end is located, the ear tip has a stepped hole penetrating through the first end and the second end, a part of the sound emitting tube is located in a large-diameter section of the stepped hole, and a small-diameter section of the stepped hole is in communication with the first through hole.

Optionally, the other end of the sound emitting tube is fixedly connected to a wall surface of the small-diameter section, a cross-section of the small-diameter section is oval-shaped, an edge of one end of the small-diameter section facing away from the large-diameter section is connected to an edge of the first end via a curved surface, and an contour of the edge of the first end is circle-shaped.

Optionally, the sound emitting tube includes a first section and a second section that are connected to each other, there is an included angle between an axis of the first section and an axis of the second section, the ear tip is fixedly connected to the first section, and a cross-section of a portion of the first through hole in the first section is oval-shaped, and a cross-section of a portion of the first through hole in the second section is circle-shaped.

Optionally, the first section is externally provided with a first clamping portion and a second clamping portion which are outwardly convex, and an inner wall of the small-diameter section has a convex portion capable of being clamped between the first clamping portion and the second clamping portion.

Optionally, the speaker assembly includes a first moving coil unit and a first balanced armature, where the first moving coil unit is located in and fixedly connected to the earphone housing, the first balanced armature is long-strip shaped, one end of the first balanced armature is connected to the first moving coil unit, and a part of the first balanced armature is located in the first through hole.

Optionally, the first balanced armature includes a first portion that is cuboid-shaped and a second portion that is column-shaped, one end of the first portion is fixedly connected to the first moving coil unit, and the other end of the first portion is fixedly connected to the second portion.

Optionally, the speaker assembly includes two second balanced armatures arranged in a stack-up manner, one end of each of the two second balanced armatures is located in and connected to the earphone housing, and the other end of each of the two second balanced armatures is located in the first through hole.

Optionally, a cross-sectional pattern of a portion of the first through hole adjacent to one end of the sound emitting tube is oval-shaped, and a stacking-up direction of the two second balanced armatures is parallel to a first long axis, and where the first long axis a long axis of the cross-sectional pattern of the portion of the first through hole adjacent to the one end of the sound emitting tube.

Optionally, the speaker assembly includes a second moving coil unit and a third moving coil unit, a size of a cross-section of the second moving coil unit is greater than a size of a corresponding cross-section of the third moving coil unit, the second moving coil unit is fixed in the earphone housing, one end of the third moving coil unit is connected to the second moving coil unit, and the other end of the third moving coil unit is located in the first through hole.

Figure 1:
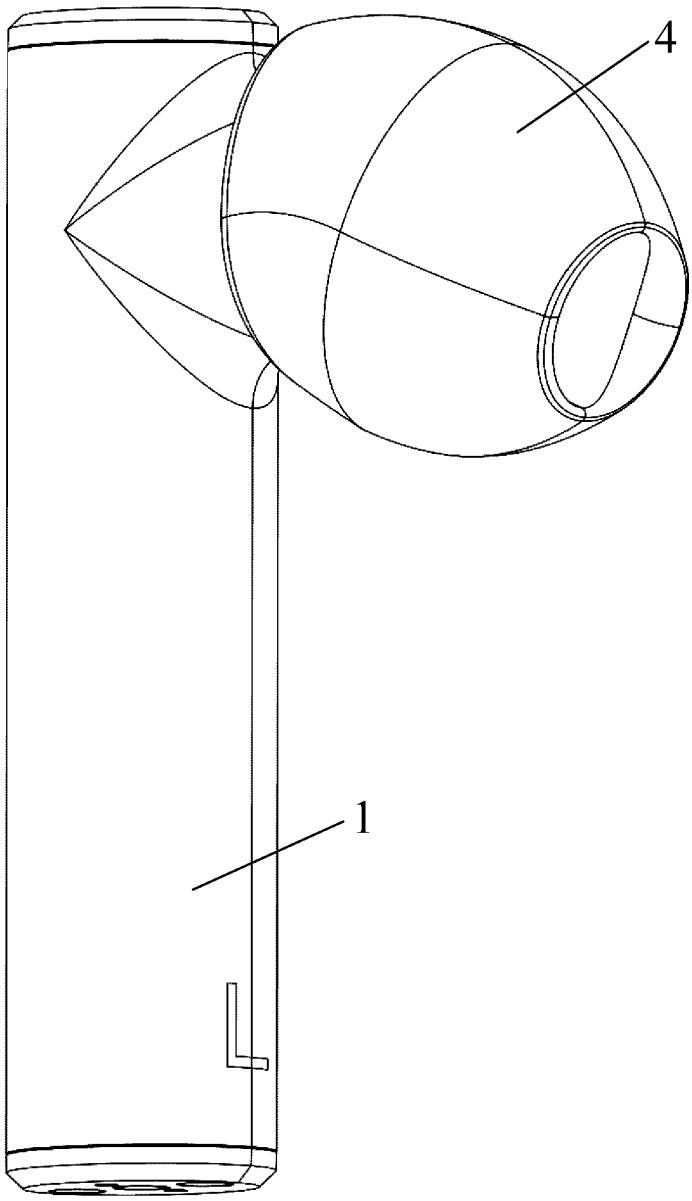
FIG. 1 illustrates a structural diagram of an in-ear earphone provided by Embodiment one of the present disclosure.

1. earphone housing; 2. speaker assembly; 21. first moving coil unit; 22. first balanced armature; 221. first portion; 222. second portion; 23. second balanced armature; 24. second moving coil unit; 25. third moving coil unit; 3. sound emitting tube; 31. first through hole; 32. first section; 321. first clamping portion; 322. second clamping portion; 33. second section; 3*a*. third end; 3*b*. fourth end; 4. ear tip; 41. first end; 42. second end; 43. small-diameter section; 44. convex portion; 4*a*. edge; 5. dustproof cover.

DETAILED DESCRIPTION

To better illustrate the solved problem, adopted solution and achieved effects of the present disclosure, the present disclosure is further described in conjunction with embodiments and drawings. It is to be understood that the embodiments set forth below are intended to merely illustrate and not to limit the present disclosure. For ease of description, only a part, not all, related to the present disclosure is illustrated in the drawings.

In the description of the present disclosure, it should be understood that the orientational or positional relationships indicated by terms "center", "above", "below", "left", "right", "vertical", "horizontal", "inside", "outside" and the like are based on the orientational or positional relationships illustrated in the drawings, which are for the mere purpose of facilitating and simplifying the description of the present disclosure, and these relationships do not indicate or imply that the device or component referred to has a specific orientation and is constructed and operated in a specific orientation, and thus it is not to be construed as limiting the present disclosure. Moreover, terms like "first" and "second" are merely used for the description and are not to be construed as indicating or implying relative importance.

In the description of the present disclosure, it should be noted that unless otherwise expressly specified and limited, terms like "mounted", "connected to each other", "connected" are to be construed in a broad sense, for example, as permanently connected, detachably connected; mechanically connected or electrically connected; directly connected or indirectly connected via an intermediate medium; or internally connected between two elements. For those of ordinary skill in the art, specific meanings of the above terms in the present disclosure can be understood according to specific conditions.

The present embodiment provides an in-ear earphone, which is convenient to be inserted into the ear and has high comfort performance.

Embodiment One

With reference to FIGS. 1 to 8, the in-ear earphone includes an earphone housing 1, a speaker assembly 2 fixed onto the earphone housing 1, an electric energy portion electrically connected to the speaker assembly 2, a sound emitting tube 3 and an ear tip 4.

Figure 2:
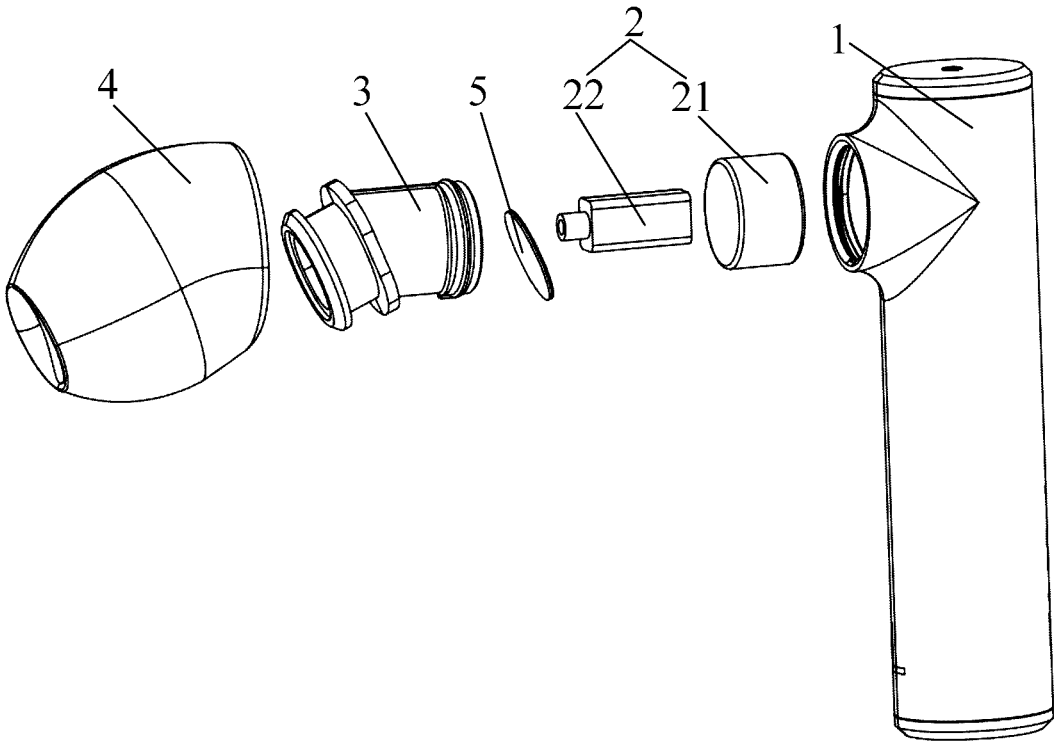
FIG. 2 illustrates an exploded structural diagram of the in-ear earphone provided by Embodiment one of the present disclosure.
Figure 3:
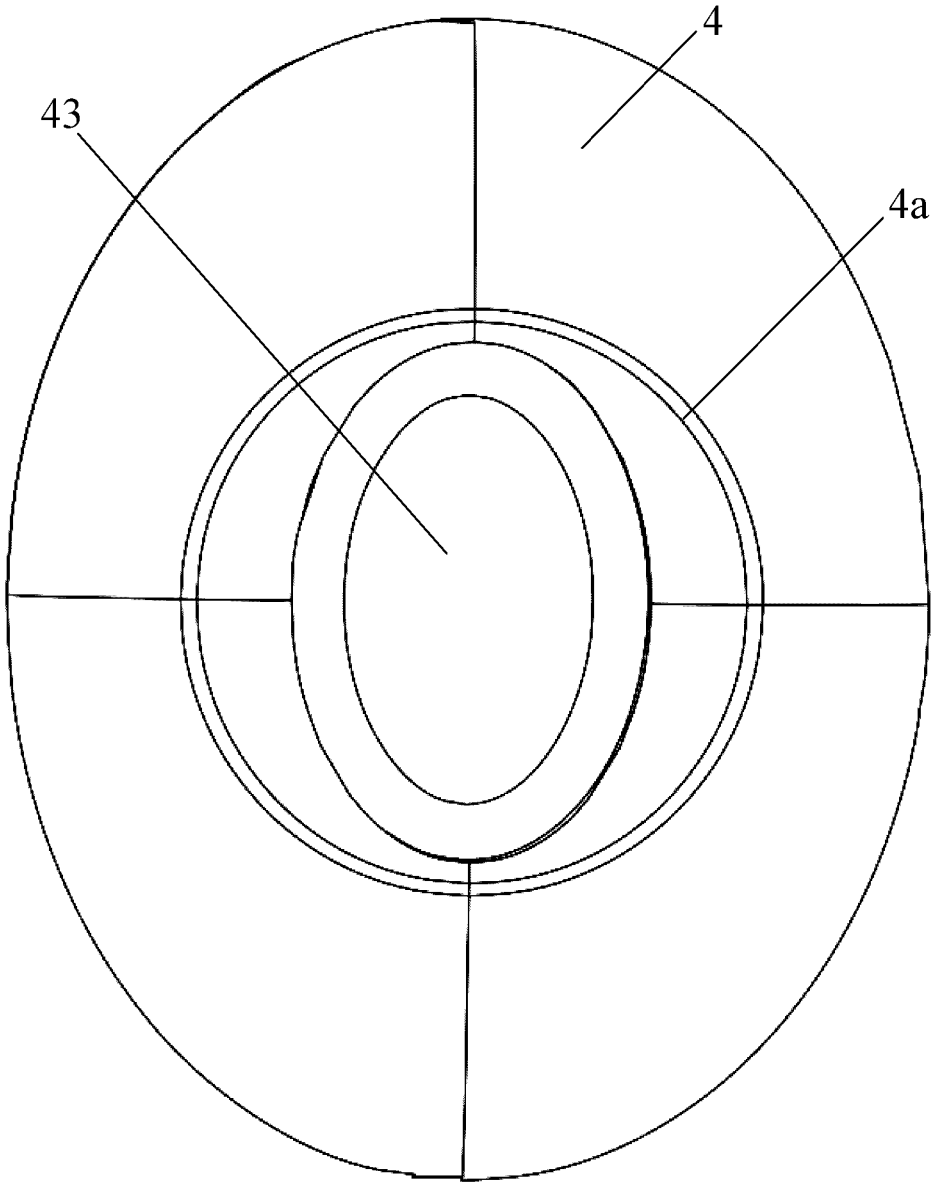
FIG. 3 illustrates a schematic structural diagram of an ear tip provided by Embodiment one of the present disclosure.
Figure 8:
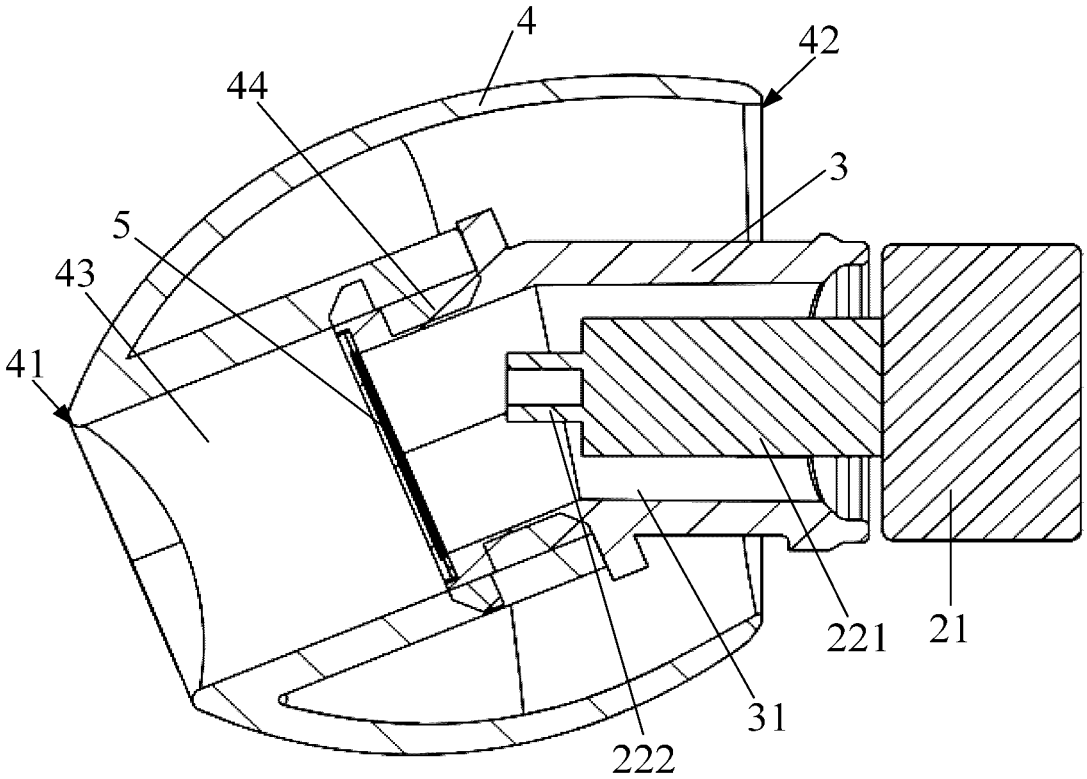
FIG. 8 illustrates a cross-sectional view taken along A-A shown in FIG. 7 of the present disclosure.
Figure 9:
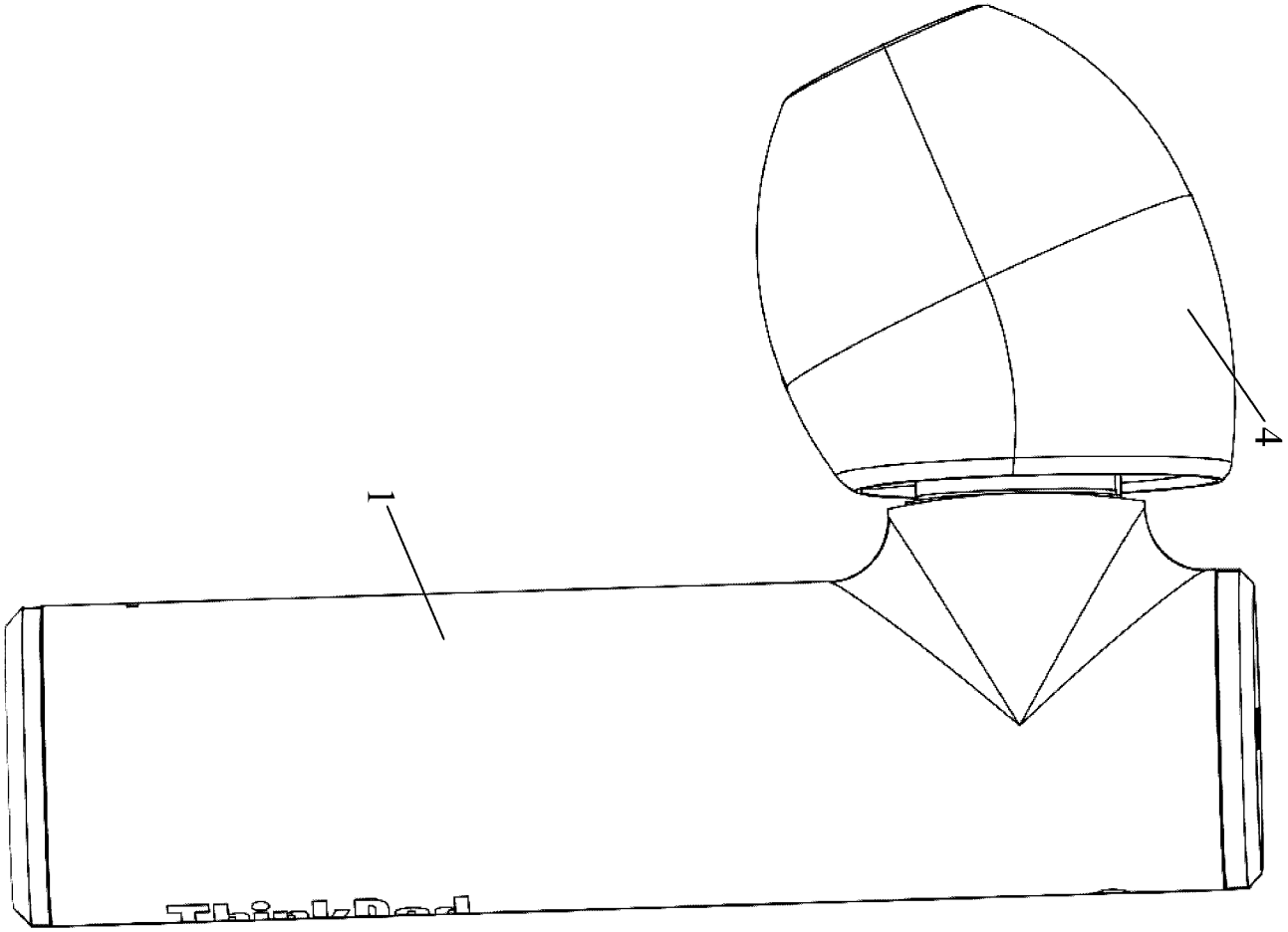
FIG. 9 illustrates a structural diagram of an in-ear earphone provided by Embodiment two of the present disclosure.
Figure 10:
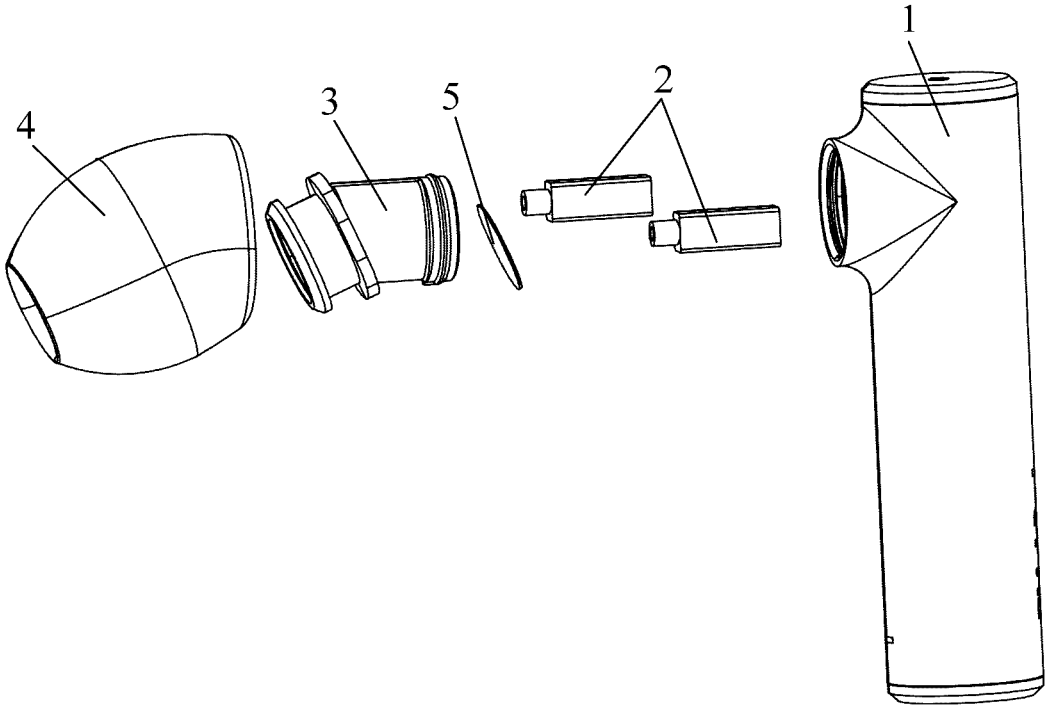
FIG. 10 illustrates an exploded structural diagram of the in-ear earphone provided by Embodiment two of the present disclosure.
Figure 11:
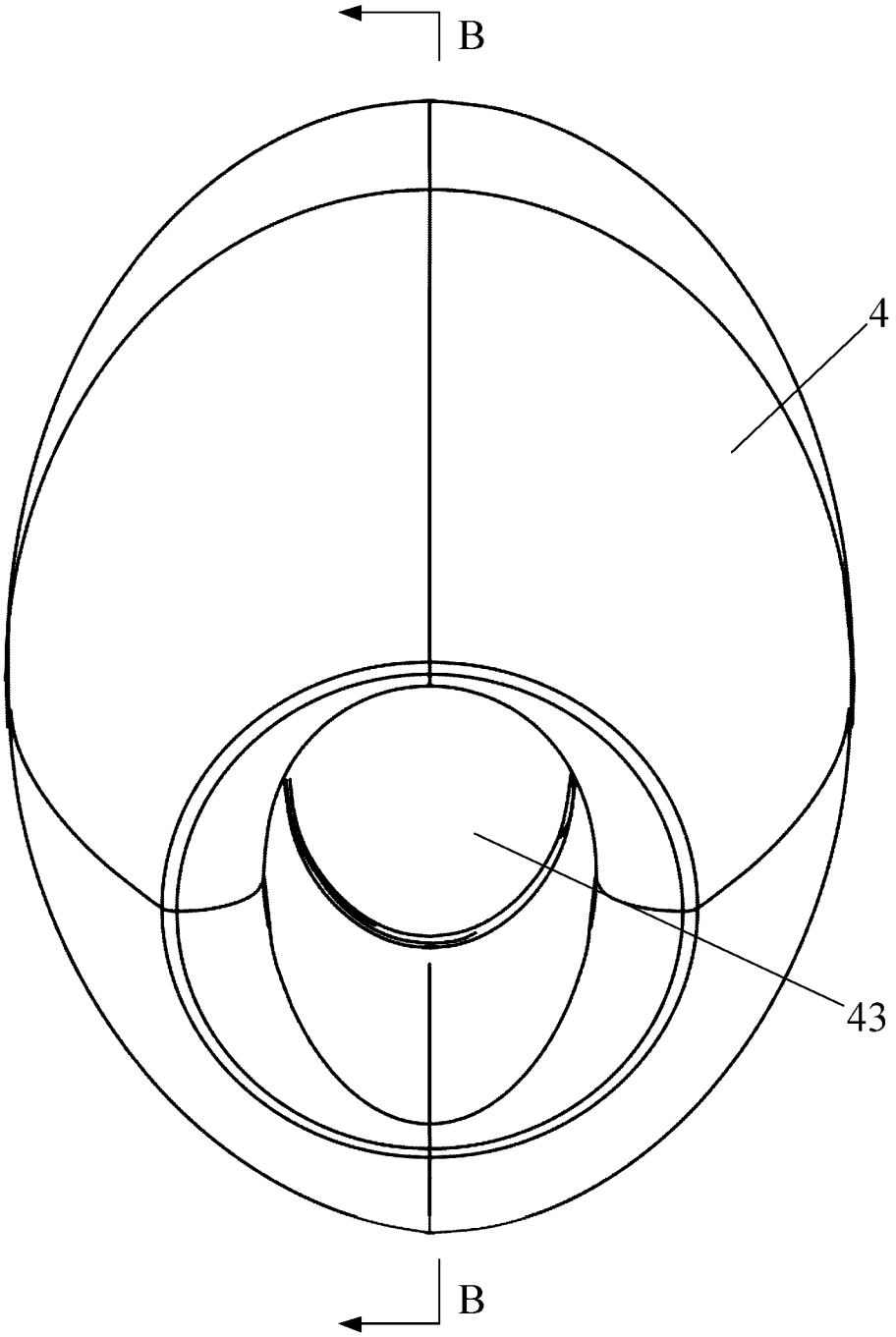
FIG. 11 illustrates a front view of a part of the in-ear earphones provided by Embodiment two of the present disclosure.
Figure 12:
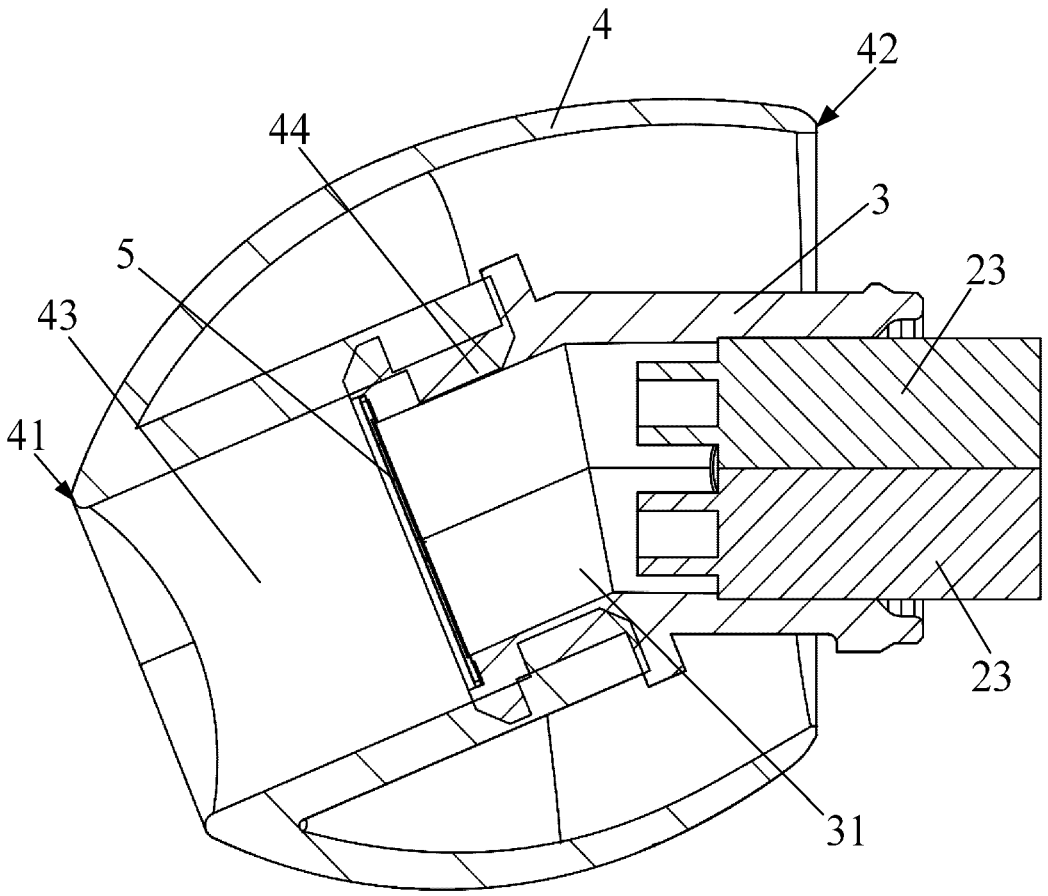
FIG. 12 illustrates a cross-sectional view taken along B-B shown in FIG. 11 of the present disclosure.
Figure 13:
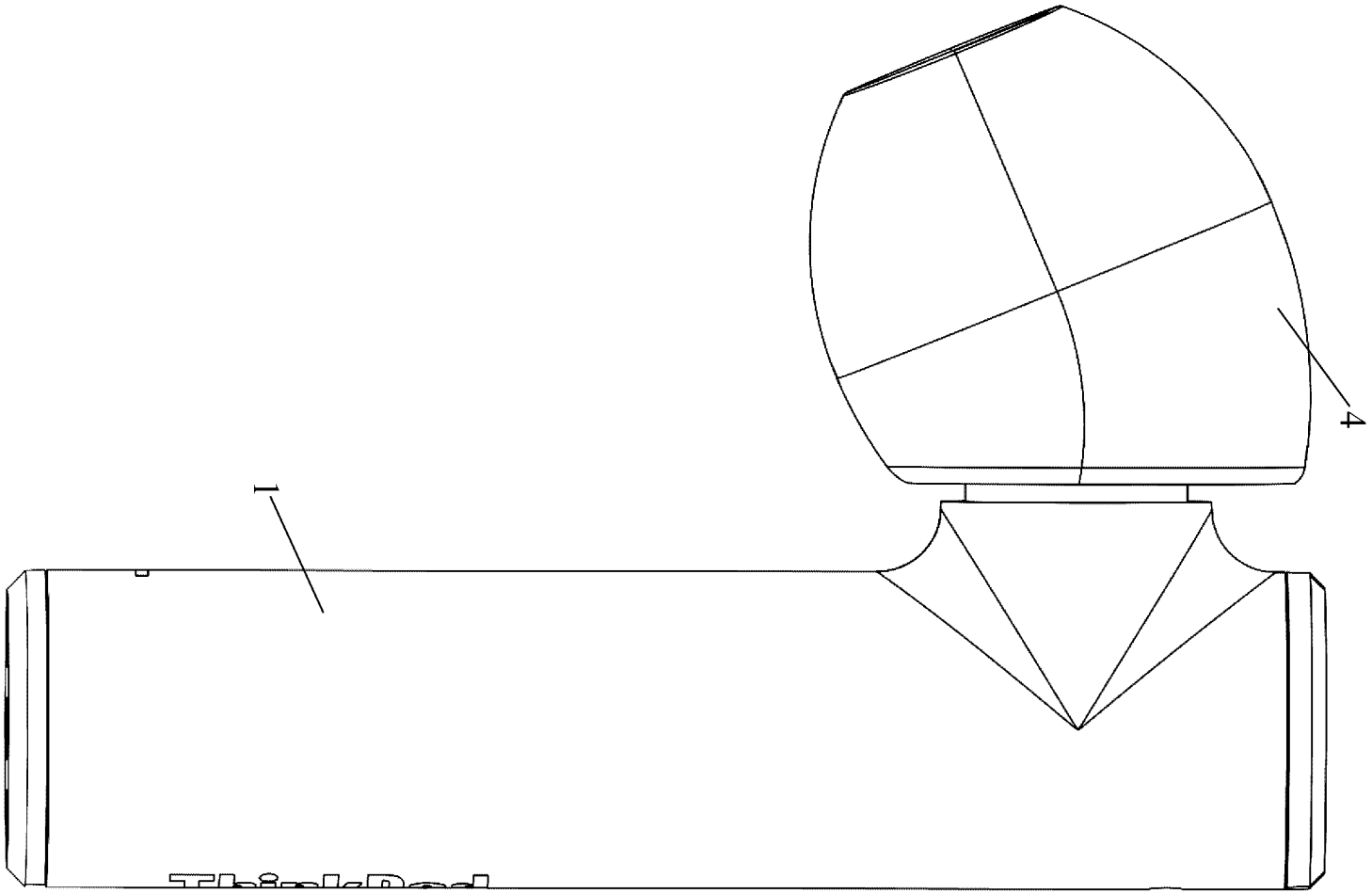
FIG. 13 illustrates a structural diagram of an in-ear earphone provided by Embodiment three of the present disclosure.
Figure 14:
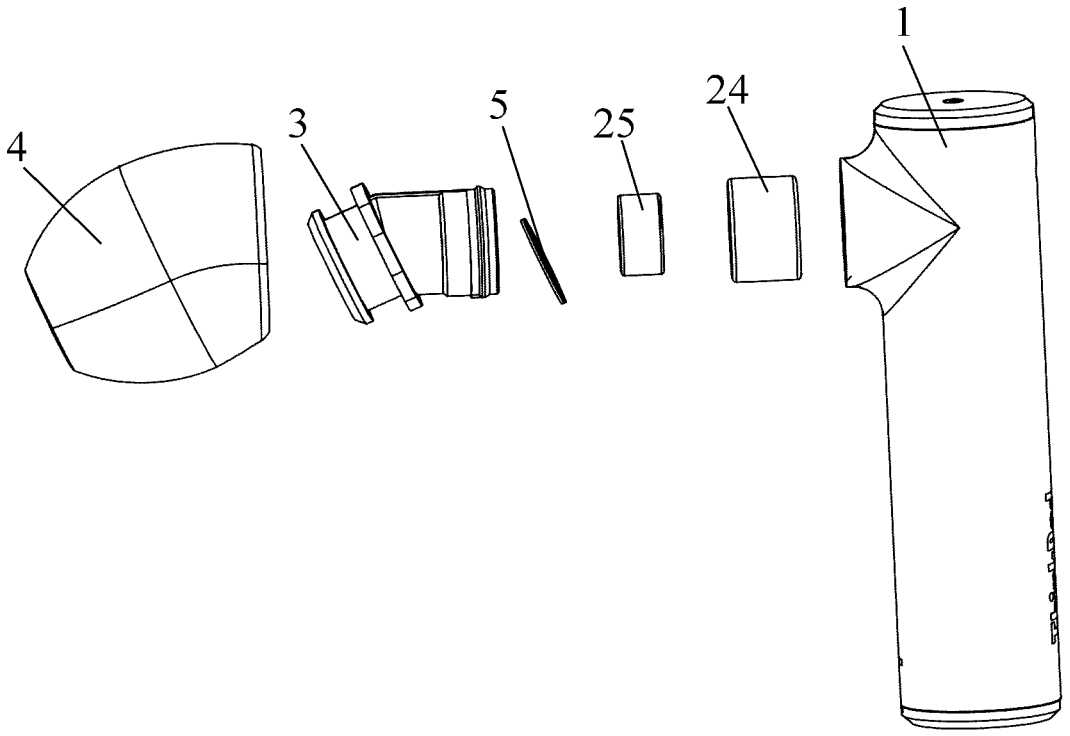
FIG. 14 illustrates an exploded structural diagram of the in-ear earphone provided by Embodiment three of the present disclosure.
Figure 15:
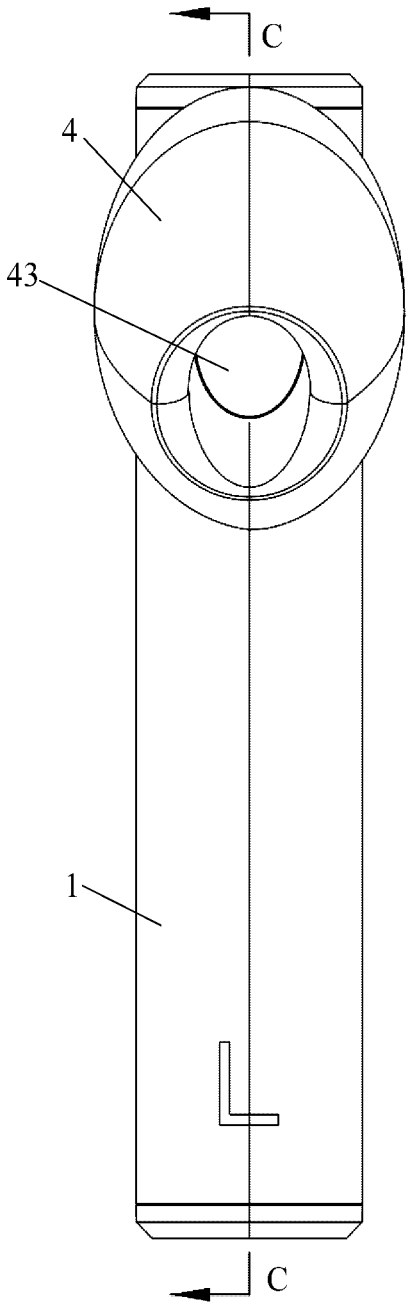
FIG. 15 illustrates a front view of the in-ear earphones provided by Embodiment three of the present disclosure.
Figure 16:
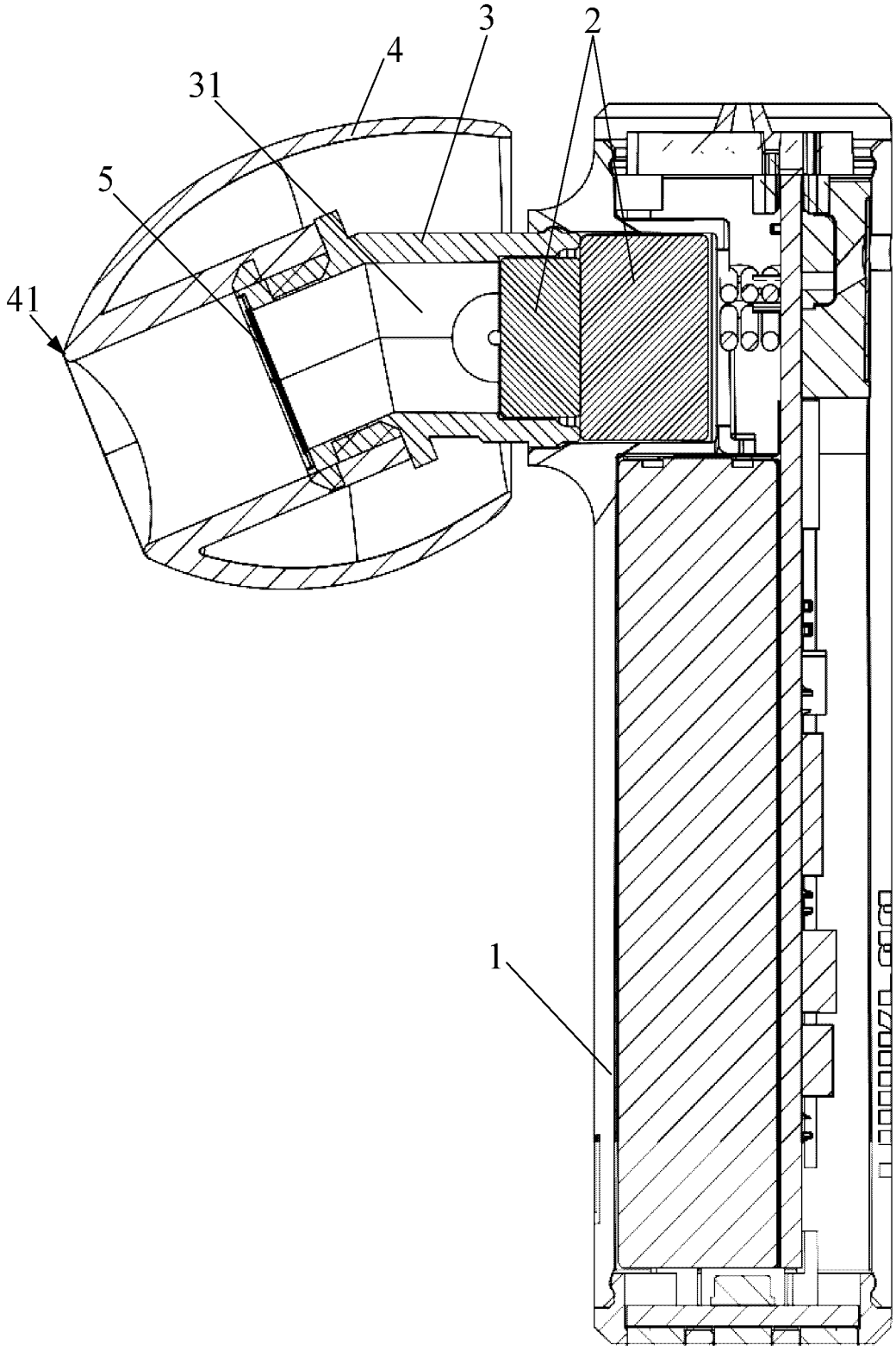
FIG. 16 illustrates a cross-sectional view taken along C-C shown in FIG. 15 of the present disclosure.

One end (hereinafter referred to as a fourth end 3*b*) of the sound emitting tube 3 is fixed onto the earphone housing 1, and as shown in FIG. 8, the sound emitting tube 3 is bent-shaped, and has a first through hole 31 penetrating through both ends of the sound emitting tube 3. The ear tip 4 is fixedly connected to the other end of the sound emitting tube 3 (hereinafter referred to as a third end 3*a*), a cross-section of the ear tip 4 is oval-shaped. Optionally, an outer contour of the ear tip 4 has a shape like a rugby ball with two ends cut off and is suitable for a human ear, which is convenient for wearing in-ear earphones. The ear tip 4 has a first end 41 and a second end 42 that face to each other, and a plane where an end surface of the first end 41 is located intersects with a plane where an end surface of the second end 42 is located, that is, the end surface of the first end 41 of the ear tip 4 is not parallel to the end surface of the second end 42 of the ear tip 4, and that is, as shown in FIG. 2, an outer surface of the ear tip 4 is formed by two arc surfaces connected to each other, where the two arc surfaces have different lengths along a first direction (as shown in FIG. 2, an upper length and a lower length of the ear tip 4 are different), and the first direction is an extension direction of the ear tip 4.

In addition, the ear tip 4 has a stepped hole penetrating through the first end 41 and the second end 42, where the stepped hole has a large-diameter section and a small-diameter section 43 that are in communication with each other. Part of the sound emitting tube 3 is located in the large-diameter section of the stepped hole, and the small-diameter section 43 of the stepped hole is in communication with the first through hole 31 of the sound emitting tube 3, so that sound generated by the speaker assembly 2 may be transmitted to the ear of the user through the first through hole 31 and the small-diameter section 43 of the sound emitting tube 3.

In the in-ear earphone provided in the present embodiment, the outer contour of the ear tip 4 can be fitted with the contour of the human ear, so that the ear tip 4 can be easily inserted into the ear, thereby facilitating the in-ear earphone to be stuck in the auricle and improving the comfort performance of the in-ear earphone, and the sound emitting tube 3 is bent-shaped and can be fitted with the structure of the ear tip 4.

Optionally, in the present embodiment, a material of the above-mentioned ear tip 4 may be an elastic material such as rubber or silicone, which can increase friction between the ear tip 4 and the auricle, thereby reducing a probability that the in-ear earphone slides out from the user auricle.

Figure 5:
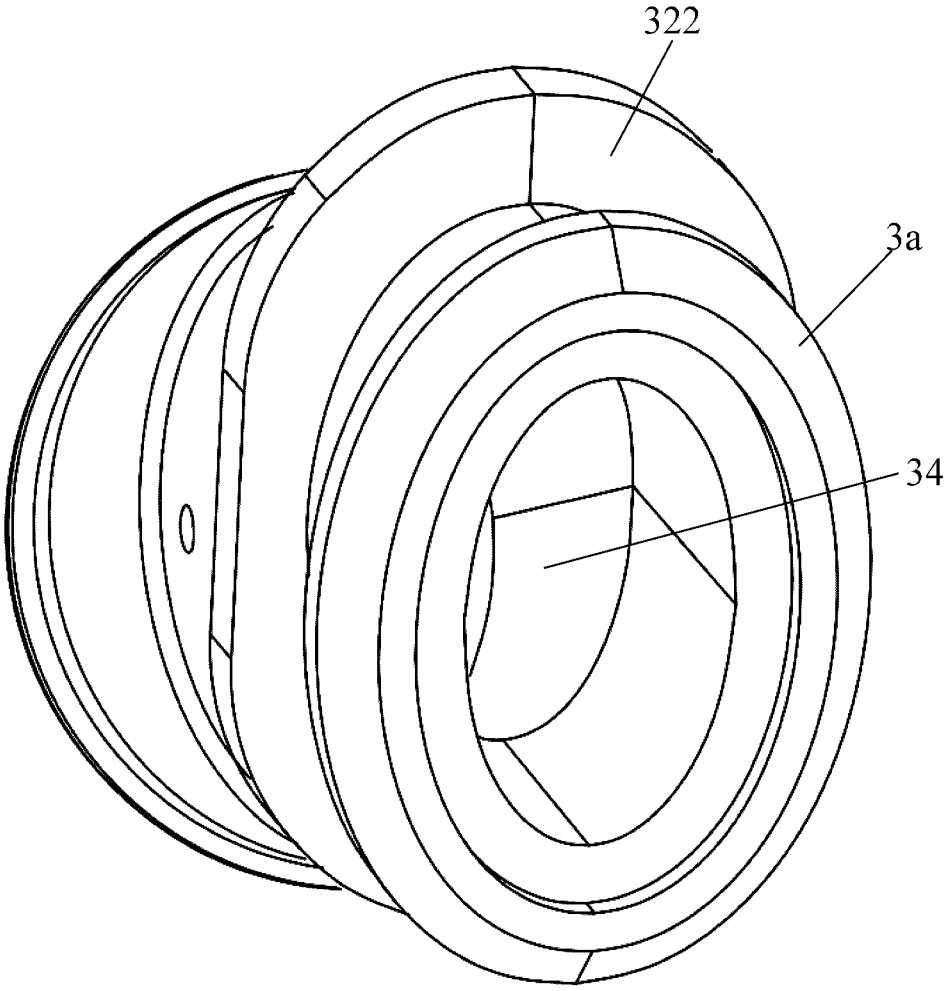
FIG. 5 illustrates a schematic structural diagram two of the sound emitting tube provided by Embodiment one of the present disclosure.
Figure 6:
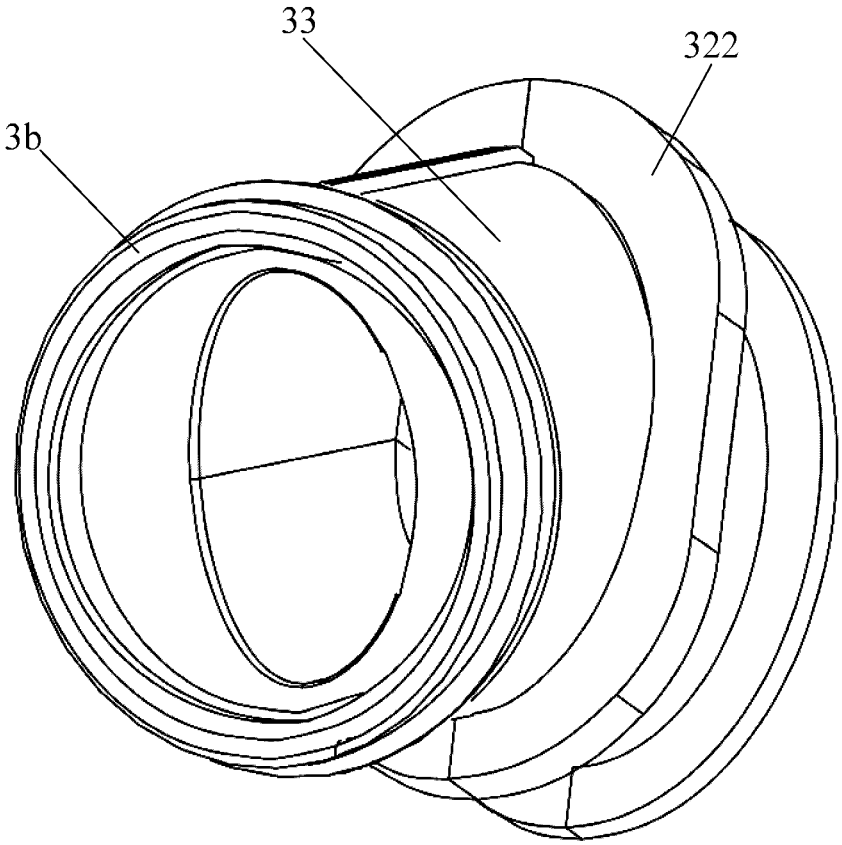
FIG. 6 illustrates a schematic structural diagram three of the sound emitting tube provided by Embodiment one of the present disclosure.
Figure 7:
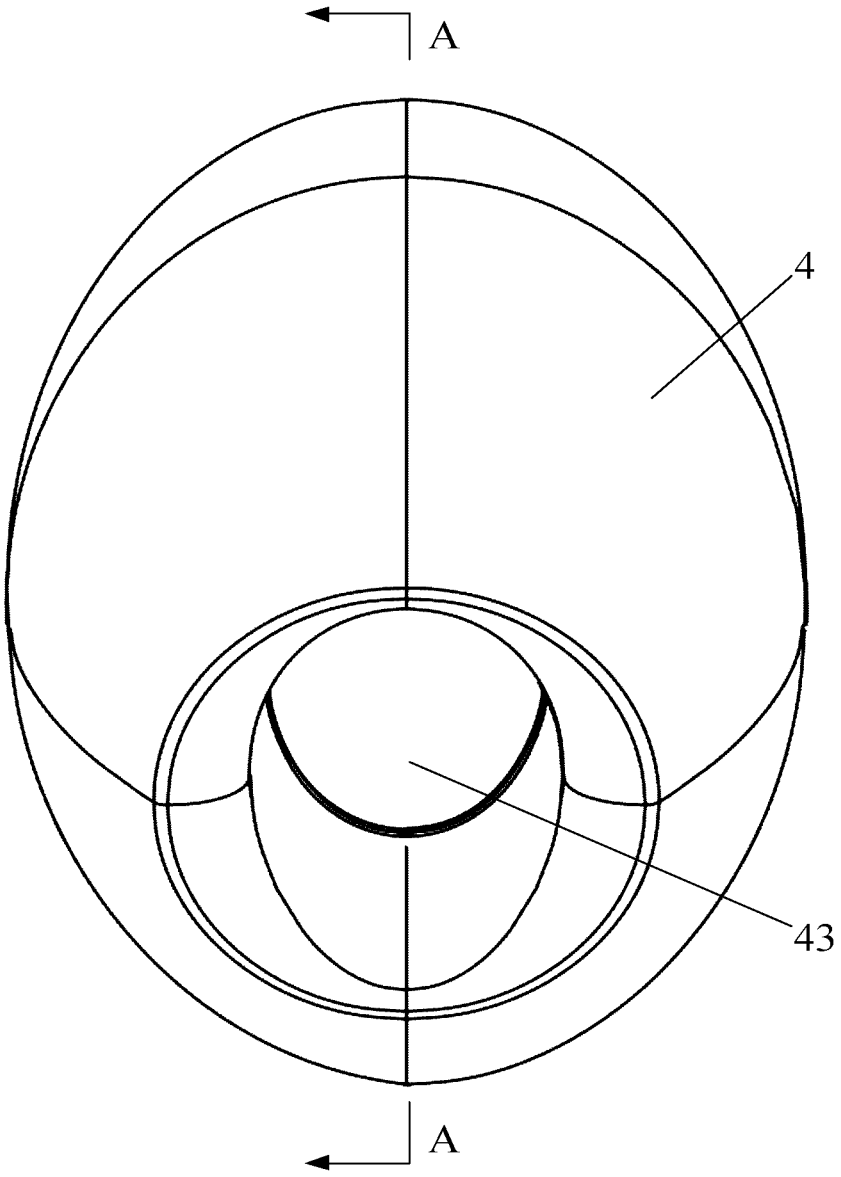
FIG. 7 illustrates a front view of a part of an in-ear earphone provided by Embodiment one of the present disclosure.

Optionally, in conjunction with FIGS. 5, 6 and 8, a cross-section of the small-diameter section 43 in an extension direction thereof is oval-shaped, and the third end 3*a* of the sound emitting tube 3 is fixedly connected to an inner wall surface of the small-diameter section 43. Furthermore, an edge of one end of the small-diameter section 43 facing away from the large-diameter section is connected to an edge 4*a* of the first end 41 of the ear tip 4 by a curved surface, and a contour of the edge 4*a* of the first end 41 is circle-shaped. That is, the edge of the small-diameter section 43 facing away from the large-diameter section and the end surface of the first end 41 of the ear tip 4 are not on an identical plane, and that is, an outlet of the stepped hole is not located on the end surface of the first end 41.

Figure 4:
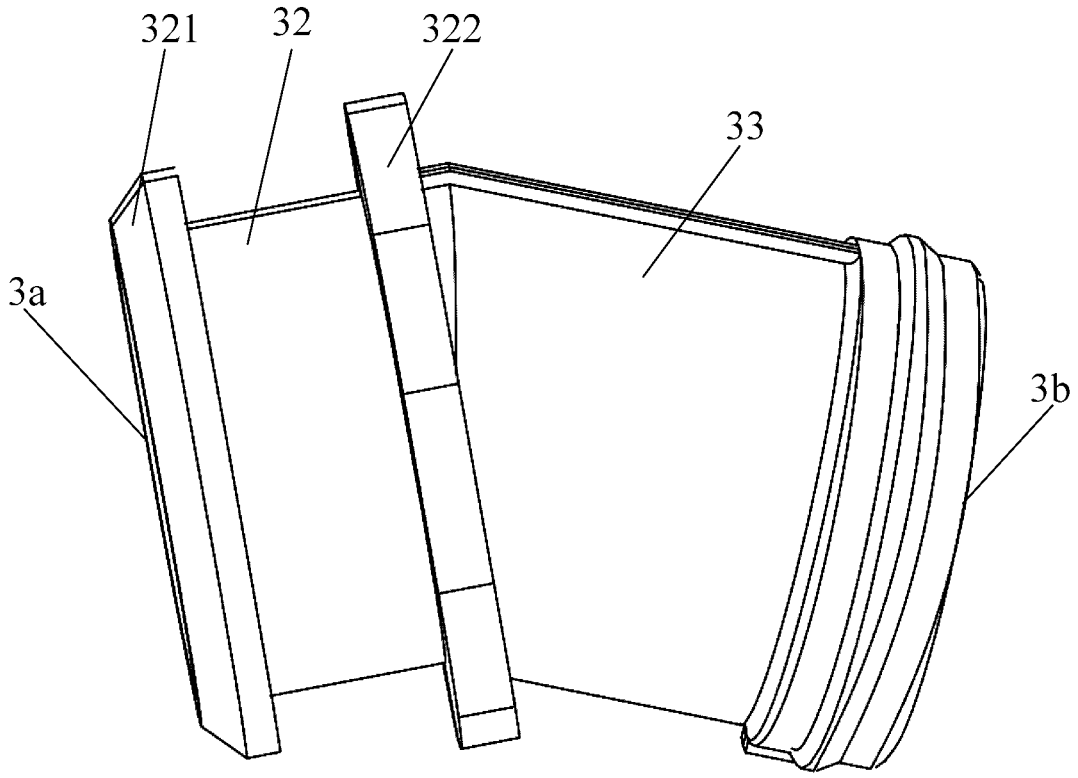
FIG. 4 illustrates a schematic structural diagram one of a sound emitting tube provided by Embodiment one of the present disclosure.

Optionally, as shown in FIG. 4, the sound emitting tube 3 may include a first section 32 and a second section 33 that are connected to each other. There is an included angle between an axis of the first section 32 and an axis of the second section 33. At this time, the third end 3*a* of the sound emitting tube 3 is an end of the first section 32 that is not connected to the second section 33, and the fourth end 3*b* of the sound emitting tube 3 is an end of the second section 33 that is not connected to the first section 32. In addition, the ear tip 4 is fixedly connected to the first section 32 via the inner wall of the small-diameter section 43 in the ear tip 4.

Optionally, as shown in FIG. 5, a cross-section of a portion of the first through hole 31 located in the first section 32 may be ellipse-shaped or in other shapes, and a cross-section of a portion of the first through hole 31 located in the second section 33 may be circle-shaped or in other shapes.

In the present embodiment, with continued reference to FIG. 4, the first section 32 is externally provided with a first clamping portion 321 and a second clamping portion 322 which are outwardly convex. The inner wall of the small-diameter section 43 of the ear tip 4 has a convex portion 44, which can be clamped between the first clamping portion 321 and the second clamping portion 322, so as to achieve a fixed connection between the ear tip 4 and the sound emitting tube 3.

In the present embodiment, with reference to FIG. 2, the speaker assembly 2 may include a first moving coil unit 21 and a first balanced armature 22. The first moving coil unit 21 is located in the earphone housing 1 and is fixedly connected to the earphone housing 1, the first balanced armature 22 is long-strip shaped, and one end of the first balanced armature 22 is connected to the first moving coil unit 2, where the part of the first balanced armature 22 can be located in the first through hole 31 of the sound emitting tube 3 (as shown in FIG. 8). Optionally, an outer size of the first balanced armature 22 may be smaller, so as to be fitted with a size of the first through hole 31, so that the first balanced armature 22 is easier to be located in the first through hole 31, thereby fully utilizing an internal space structure of the sound emitting tube 3, making an internal structure of the in-ear earphone more compact, and greatly improving a space utilization rate, which improve the user experience.

In addition, designs of the first moving coil unit 21 and the first balanced armature 22 makes the in-ear earphones not only have high resolution, high transient state, and excellent detail performance, but also may have a good density of mid-high frequency, and may get a large dynamic loose atmosphere, low-frequency elasticity and dive, making the in-ear earphone in the present embodiment combine advantages of the first moving coil unit 21 and the first balanced armature 22 into one.

Optionally, the first balanced armature 22 includes a first portion 221 that is cuboid-shaped and a second portion 222 that is column-shaped. One end of the first portion 221 is fixedly connected to the first moving coil unit 21, and the other end of the first portion 221 is fixedly connected to the second portion 222. Optionally, the above-mentioned part of the first balanced armature 22 includes the second portion 222 and most part of the first portion 221, further making the structure of the in-ear earphone provided in the present embodiment more compact. The first moving coil unit 21 may be cylinder-shaped, and an upper surface (or a lower surface) of the first moving coil unit 21 is in contact with and connected to the first balanced armature 22.

Optionally, with reference to FIGS. 2 and 8, the in-ear earphone may further include a dustproof cover 5 which is fixed to the third end 3*a* of the sound emitting tube 3, and is used to prevent dust in the air from entering the first through hole 31 of the sound emitting tube 3.

Embodiment Two

A difference between the in-ear earphone provided in the present embodiment and the in-ear earphone provided in Embodiment one is that the structures of the speaker assembly 2 and the sound emitting tube 3 in the present embodiment are different from those in Embodiment one.

Optionally, as shown in FIGS. 9 to 12, the speaker assembly 2 includes two second balanced armatures 23 arranged in a stack-up manner. One end of each of the two second balanced armatures 23 are both located in the earphone housing 1 and is fixedly connected to the earphone housing 1, and the other end of each of the two second balanced armatures 23 are located in the first through hole 31 of the sound emitting tube 3. The design of the two second balanced armatures can effectively improve the low-frequency elasticity and dive of the in-ear earphone.

Optionally, in the present embodiment, a cross-sectional pattern of a portion of the first through hole 31 of the sound emitting tube 3 adjacent to one end (that is, the fourth end 3*b* of the sound emitting tube 3 in Embodiment one) of the sound emitting tube 3 is oval-shaped, and a stacking-up direction of the two second balanced armatures 23 is parallel to a first long axis, which is a long axis of the cross-sectional pattern (that is, oval-shaped) of the portion of the first through hole 31 adjacent to the one end of the sound emitting tube 3, and therefore, the two second balanced armatures 23 can fully utilize the internal structural space of the sound emitting tube 3. In addition, except that the cross-sectional shape of the first through hole 31 is different from that of the first through hole in Embodiment one, other structures of the sound emitting tube 3 in the present embodiment are the same as the corresponding structures of the sound emitting tube 3 in Embodiment one, which are not described in the present embodiment.

Optionally, the structure of the second balanced armature 23 may refer to that of the first balanced armature 22 in Embodiment one, and is not described in the present embodiment.

It should be noted that other structures in the present embodiment are the same as other corresponding structures in Embodiment one, and will not be described in the present embodiment.

Embodiment Three

A difference between the in-ear earphone provided in the present embodiment and the in-ear earphone provided in Embodiment one is that the structure of the speaker assembly 2 in the present embodiment is different from that provided in Embodiment one.

Optionally, as shown in FIGS. 13 to 16, the speaker assembly 2 includes a second moving coil unit 24 and a third moving coil unit 25. A size of a cross-section of the second moving coil unit 24 is greater than a size of a corresponding cross-section of the third moving coil unit 25, the second moving coil unit 24 is fixed in the earphone housing 1, one end of the third moving coil unit 25 is connected to the second moving coil unit 24, and the other end of the third moving coil unit 25 is located in the first through hole 31. Designs of the second moving coil unit 24 and the third moving coil unit 25 can enable the in-ear earphones to effectively show details of music and improve the user experience.

Optionally, the cross-sectional shape of the third moving coil unit 25 is the same as that of the first through hole 31, and the cross-sectional size of the third moving coil unit 25 is equal to that of the first through hole 31, so that the third moving coil unit 25 can make better use of the internal structural space of the sound emitting tube 3.

It should be noted that other structures in the present embodiment are the same as other corresponding structures in Embodiment one, and will not be described here.

The present disclosure includes at least the following beneficial effects:

In the in-ear earphone provided by the present disclosure, an outer contour of the ear tip can be fitted with a contour of a human ear, so that the ear tip can be easily inserted into the ear, thereby facilitating the in-ear earphone to be stuck in an auricle, and improving comfort performance after the in-ear earphone inserted into the ear, and the sound emitting tube is bent-shaped, which can be fitted with a structure of the ear tip;

The first balanced armature in the disclosure can be fitted with a size of the first through hole, thereby making it easier for the first balanced armature to be located in the first through hole, so that an internal space structure of the sound emitting tube can be fully utilized, and the internal structure of the in-ear earphone can be more compact, which greatly improves space utilization rate and improves the user experience;

In the present disclosure, designs of the first moving coil unit and the first balanced armature makes the in-ear earphones not only have high resolution, high transient state, and excellent detail performance, but also can have a good density of mid-high frequency, and can achieve a large dynamic loose atmosphere, low-frequency elasticity and dive, making the in-ear earphone combine advantages of the first moving coil unit and the first balanced armature into one.

In the disclosure, the design of the two second balanced armatures can effectively improve the low-frequency elasticity and dive of the in-ear earphone.

Moreover, in the disclosure, designs of the second moving coil unit and the third moving coil unit can enable the in-ear earphones to effectively show details of music and improve the user experience.

What is claimed is:

1. An in-ear earphone, comprising an earphone housing, a speaker assembly fixed onto the earphone housing, and further comprising:

a sound emitting tube, one end of which is fixed onto the earphone housing, wherein the sound emitting tube is bent-shaped and has a first through hole penetrating through both ends of the sound emitting tube; and an ear tip fixedly connected to the other end of the sound emitting tube, wherein a cross-section of the ear tip is oval-shaped, the ear tip has a first end and a second end that face to each other, a plane where an end surface of the first end is located is configured to intersect with a plane where an end surface of the second end is located, the ear tip has a stepped hole penetrating through the first end and the second end, a part of the sound emitting tube is located in a large-diameter section of the stepped hole, and a small-diameter section of the stepped hole is in communication with the first through hole, wherein the other end of the sound emitting tube is fixedly connected to a wall surface of the small-diameter section, a cross-section of the small-diameter section is oval-shaped, an edge of one end of the small-diameter section facing away from the large-diameter section is connected to an edge of the first end via a curved surface, and an contour of the edge of the first end is circle-shaped.

2. An in-ear earphone, comprising an earphone housing, a speaker assembly fixed onto the earphone housing, and further comprising:

a sound emitting tube, one end of which is fixed onto the earphone housing, wherein the sound emitting tube is bent-shaped and has a first through hole penetrating through both ends of the sound emitting tube; and an ear tip fixedly connected to the other end of the sound emitting tube, wherein a cross-section of the ear tip is oval-shaped, the ear tip has a first end and a second end that face to each other, a plane where an end surface of the first end is located is configured to intersect with a plane where an end surface of the second end is located, the ear tip has a stepped hole penetrating through the first end and the second end, a part of the sound emitting tube is located in a large-diameter section of the stepped hole, and a small-diameter section of the stepped hole is in communication with the first through hole, wherein the sound emitting tube comprises a first section and a second section that are connected to each other, there is an included angle between an axis of the first section and an axis of the second section, the ear tip is fixedly connected to the first section, and a cross-section of a portion of the first through hole in the first section is oval-shaped, and a cross-section of a portion of the first through hole in the second section is circle-shaped.

3. The in-ear earphone according to claim 2, wherein the first section is externally provided with a first clamping portion and a second clamping portion which are outwardly convex, and an inner wall of the small-diameter section has a convex portion capable of being clamped between the first clamping portion and the second clamping portion.

4. An in-ear earphone, comprising an earphone housing, a speaker assembly fixed onto the earphone housing, and further comprising:

a sound emitting tube, one end of which is fixed onto the earphone housing, wherein the sound emitting tube is bent-shaped and has a first through hole penetrating through both ends of the sound emitting tube; and an ear tip fixedly connected to the other end of the sound emitting tube, wherein a cross-section of the ear tip is oval-shaped, the ear tip has a first end and a second end that face to each other, a plane where an end surface of the first end is located is configured to intersect with a plane where an end surface of the second end is located, the ear tip has a stepped hole penetrating through the first end and the second end, a part of the sound emitting tube is located in a large-diameter section of the stepped hole, and a small-diameter section of the stepped hole is in communication with the first through hole, wherein the speaker assembly comprises a first moving coil unit and a first balanced armature;

wherein the first moving coil unit is located in and fixedly connected to the earphone housing, the first balanced armature is long-strip shaped, one end of the first balanced armature is connected to the first moving coil unit, and a part of the first balanced armature is located in the first through hole.

5. The in-ear earphone according to claim 1, wherein the speaker assembly comprises a first moving coil unit and a first balanced armature;

wherein the first moving coil unit is located in and fixedly connected to the earphone housing, the first balanced armature is long-strip shaped, one end of the first balanced armature is connected to the first moving coil unit, and a part of the first balanced armature is located in the first through hole.

6. The in-ear earphone according to claim 2, wherein the speaker assembly comprises a first moving coil unit and a first balanced armature;

wherein the first moving coil unit is located in and fixedly connected to the earphone housing, the first balanced armature is long-strip shaped, one end of the first balanced armature is connected to the first moving coil unit, and a part of the first balanced armature is located in the first through hole.

7. The in-ear earphone according to claim 3, wherein the speaker assembly comprises a first moving coil unit and a first balanced armature;

wherein the first moving coil unit is located in and fixedly connected to the earphone housing, the first balanced armature is long-strip shaped, one end of the first balanced armature is connected to the first moving coil unit, and a part of the first balanced armature is located in the first through hole.

8. The in-ear earphone according to claim 4, wherein the first balanced armature comprises a first portion that is cuboid-shaped and a second portion that is column-shaped, one end of the first portion is fixedly connected to the first moving coil unit, and the other end of the first portion is fixedly connected to the second portion.

9. The in-ear earphone according to claim 1, wherein the speaker assembly comprises two second balanced armatures arranged in a stack-up manner, one end of each of the two second balanced armatures is located in and connected to the earphone housing, and the other end of each of the two second balanced armatures is located in the first through hole.

10. The in-ear earphone according to claim 2, wherein the speaker assembly comprises two second balanced armatures arranged in a stack-up manner, one end of each of the two second balanced armatures is located in and connected to the earphone housing, and the other end of each of the two second balanced armatures is located in the first through hole.

11. The in-ear earphone according to claim 3, wherein the speaker assembly comprises two second balanced armatures arranged in a stack-up manner, one end of each of the two second balanced armatures is located in and connected to the earphone housing, and the other end of each of the two second balanced armatures is located in the first through hole.

12. The in-ear earphone according to claim 1, wherein the speaker assembly comprises a second moving coil unit and a third moving coil unit, a size of a cross-section of the second moving coil unit is greater than a size of a corresponding cross-section of the third moving coil unit, the second moving coil unit is fixed in the earphone housing, one end of the third moving coil unit is connected to the second moving coil unit, and the other end of the third moving coil unit is located in the first through hole.

* * * * *